US008613329B2

(12) United States Patent
Reddoch, Sr.

(10) Patent No.: US 8,613,329 B2
(45) Date of Patent: Dec. 24, 2013

(54) METHOD AND APPARATUS FOR EFFICIENT HANDLING OF DRILL CUTTINGS

(76) Inventor: Jeffrey A. Reddoch, Sr., Lafayette, LA (US)

( * ) Notice: Subject to any disclaimer, the term of this patent is extended or adjusted under 35 U.S.C. 154(b) by 378 days.

(21) Appl. No.: 12/989,987

(22) PCT Filed: May 7, 2009

(86) PCT No.: PCT/US2009/043211

§ 371 (c)(1),
(2), (4) Date: Oct. 28, 2010

(87) PCT Pub. No.: WO2009/137724

PCT Pub. Date: Nov. 12, 2009

(65) Prior Publication Data

US 2011/0036633 A1 Feb. 17, 2011

Related U.S. Application Data

(60) Provisional application No. 61/126,958, filed on May 7, 2008.

(51) Int. Cl.
*E21B 21/06* (2006.01)

(52) U.S. Cl.
USPC ..... 175/66; 175/206; 175/207

(58) Field of Classification Search
USPC ..... 175/66, 206, 207
See application file for complete search history.

(56) References Cited

U.S. PATENT DOCUMENTS

| | | | | |
|---|---|---|---|---|
| 5,913,372 | A * | 6/1999 | Dietzen | 175/66 |
| 6,179,070 | B1 * | 1/2001 | Dietzen | 175/66 |
| 6,230,911 | B1 * | 5/2001 | Zakula et al. | 212/312 |
| 6,585,115 | B1 | 7/2003 | Reddoch et al. | |

FOREIGN PATENT DOCUMENTS

| | | |
|---|---|---|
| EP | 0 997 607 A2 | 3/2000 |

* cited by examiner

*Primary Examiner* — Giovanna Wright
(74) *Attorney, Agent, or Firm* — Lemoine & Associates LLC

(57) ABSTRACT

A traveling cuttings distributor (TCD) system that is capable of horizontal and vertical positioning for use in vacuuming, auguring or pumping drill cuttings from a drill rig shaker screen trough, drying/minimizing the cuttings and depositing by gravity cuttings while under vacuum into individual cuttings boxes as it moves from one cuttings box to the next or to a bulk system, a cuttings injection system or other cuttings processing system, the system including a vacuum tank having a filter system therein and a large silencer or exhaust system separated by a blower system capable of producing a high vacuum on an opening in the vacuum tank for engaging an opening in a cuttings box or other cuttings processing equipment. The TCD system is capable of being operated without the need for skilled service personnel, while further improving drilling performance, providing reduced environmentally friendly waste material and volumes, recovers expensive drilling mud, thus, reducing the cost of cuttings waste disposal.

12 Claims, 6 Drawing Sheets

METHOD AND APPARATUS FOR EFFICIENT HANDLING OF DRILL CUTTINGS

CROSS REFERENCE TO RELATED APPLICATIONS

This PCT application claims priority based on U.S. Provisional Patent Application No. 61/126,958 filed May 7, 2008.

1. FIELD OF THE INVENTION

This invention relates generally to means for the efficient handling of drill cuttings produced during drilling of an earth bore. During drilling drill cuttings are circulated to the surface by drilling fluid returning from the bottom of the bore. At the surface effort is made to separate most of the drilling fluid for recirculation downhole from cuttings to be collected for disposal. The invention disclosed and claimed herein relates generally to efficient handling of drill cuttings from the time cuttings, wetted with drilling mud, are collect into the cuttings trough of a drilling rig through the time they are collected into containers for further processing. Most frequently, but not always, this will be particularly applicable to transferring drill cuttings from cuttings trough of the drilling rig to cuttings boxes located on the deck of said drilling rig or drilling location, or other such cuttings processing equipment used for drying, recycling of mud, sizing, mixing and injecting cuttings, and bulk transfer tanks and the transfer and handling of such cuttings boxes on or transferred from the rig deck to or from a work boat.

2. GENERAL BACKGROUND

As well known by those in the art offshore drilling rigs generally use cutting boxes stacked on deck to collect and store drill cuttings/fluids being removed from the well bore. After passing through shale shaker screens (which are used to remove excess drilling fluids and mud from the cuttings) said cuttings are usually dropped into a cuttings trough of the drilling rig. As said cuttings troughs have limited capacity they must, more of less continuously, be removed therefrom, lest they become filled and drilling must stop for having no place to put more cuttings coming from the earth bore. Consequently drill cuttings are usually move from the cuttings trough of drilling rigs by conveyors, pumps or vacuum systems to cuttings boxes, where they are stored until they can be properly disposed off. The process for filling the cuttings boxes is labor intensive and requires significant utilization of the drilling rig crane to move the boxes around on deck and transferring each box to and from means for transportation elsewhere for disposal.

The current process requires the cuttings boxes to be moved by crane into the filling position below a cuttings conveyance outlet or connected to vacuum system. Extensive labor is necessary to manually open the cuttings box lid and install the vacuum lid which seals that cuttings box interior for vacuuming/filling, and then to remove the vacuum lid after the cuttings box is filled with cuttings, and close the lid. The space required for the current system is significant in relation the disclosed invention, thus requiring cuttings boxes to be removed shortly after filling, to make room for an empty cuttings box. On all but wells where drilling is progressing slowly the crane and several personnel are kept busy moving cuttings boxes in and out. Many of the cuttings boxes are partially filled due to this labor intensive process. In most cases, a considerable amount of expensive drilling mud, which could be reused, is disposed of along with the drill cuttings using current systems. The resulting waste product is therefore more costly to transport due to the higher volumes, thus adding to the disposal cost. And the cost to treat oily laden cuttings is much higher.

3. OBJECTS OF THE INVENTION

Objects of the disclosed invention include minimizing crane time, reduction of labor requirements, reclaiming expensive mud products, reducing disposal volumes and cost, improve the environmental quality of the waste material which also reduces further treating costs downstream, providing a means for monitor hole cleaning and speeding up the drilling process.

Another object of the disclosed invention is to allow for cuttings minimizers, dryers or other cuttings processing equipment to be placed in a traveling frame. This again reduces deck space requirements, and allows for further cuttings volumes reduction and recycling of valuable drilling mud. The disclosed invention will move over cuttings boxes, bulk containers, cuttings grinding and injection systems or any other type of cuttings equipment equally as well.

4. SUMMARY OF THE INVENTION

The cuttings handling system described herein utilizes a Traveling Cutting Distributor (hereinafter "TCD") movable horizontally on a deck of a drilling rig or nearby work surface for receiving cuttings from the drilling rigs cuttings trough and depositing the cuttings into individual containers as it moves from container to the next. The TCD may include a vacuum tank having an optional filter system therein and a large exhaust or silencer vessel separated by a blower system capable of producing a high vacuum on an opening in the vacuum tank that engages an opening in the cuttings boxes. In addition to being movable horizontally along the deck of drilling rig or nearby structure and upper section of the TCD may also be capable of vertical movement. Cuttings boxes (and other means for receiving drill cuttings) may be lined up in successive rows to allow one or more of the TCDs to pass over them. In the vacuum mode, the lid of each box can be lifted and opened or removed by a winch or similar device attached to the TCD. The TCD may then be advanced and positioned manually or automatically over another cutting box (or other means for receiving drill cuttings, including other types of containers, including slurry units, cutting dryers, shunt lines or tank of cuttings reinjection equipment). The vacuum tank may be vertically positioned to engage and seal around the opening in the cuttings box (or other means for receiving drill cuttings) thereby forming a seal between the vacuum tank and the cuttings box (or other means for receiving drill cuttings). Drill cuttings are drawn into vacuum tank by high velocity air flowing in suction line in communication with source of drill cuttings (such as cuttings trough of a drilling rig). High velocity flow of air in suction line is caused by exhausting air at high rate from the vacuum tank. Volume of vacuum tank is selected so that air flowing from suction line to exhaust slows sufficiently that heavier than air drill cutting and drilling fluid are dropped into vacuum tank as air flows therethrough. In an alternative embodiment of the invention a cutting box (or other container for receiving drill cuttings and drilling fluids) may sealingly engaged with lid attached to vertically movable portion of TCD. In said embodiment air flows from suction line in communication with one port on lid, through cutting box (or other container) and our of exhaust port on lid, dropping drill cutting in the cutting box (or other container) during passage through said container. Vacuuming cuttings into the vacuum tank (part of which may be cuttings box or other container for receiving drill cuttings) permits the heavy cuttings and fluids to fall into the cutting box (or other means for receiving drill cuttings) while discharging air to the atmosphere. Sensors can be used with any type of transfer system to determine when the cuttings box (or other means for receiving drill cuttings) is filled to desired capacity and may signal and operator or automatically moves the TCD to the next cuttings box (or other means for receiving drill cuttings). The entire system may be fully automated or at least used to minimize number and time that personnel are required to monitor and operate the cuttings collection system.

For lifting empty cuttings boxes a series of pins and rods may be used to connect the cutting boxes in groups of two, four, six or eight, depending on the crane capacity, thereby reducing the number of lifts required.

The TCD may also be used to deliver cuttings to a cutting processor for down hole injection or other processing systems such as dryers and the like used to reclaim expensive drilling mud and fluids, and reduce weight. The TCD can also be used for transferring cuttings for various other types of applications.

In one embodiment of the invention the TCD utilizes a vacuum system, vacuum tank and lid mounted within the traveling frame. The vacuum system can be independent of the moveable frame, and the moveable frame could still move over each cutting box (or other means for receiving drill cuttings) and deposit drill cuttings therein.

In another embodiment a cuttings transfer pumping system is used to transfer cuttings from the shaker trough to the TCD, when a vacuum system would might not be used for this operation. The TCD opens and closes the cuttings box lid without extensive labor, puts the vacuum lid on and takes the vacuum lid off after the cuttings box is filled, without labor. Several boxes can be placed in filling position in the same space that it used to take with the current system. Thus, several boxes are filled, prior to the rig crane being required to remove the filled cuttings boxes from the filling position. Another object of the disclosed invention, is to work equally as well in heavy weather, as the TCD is doing the work that human labor is currently used to do.

5. BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

6. DETAILED DESCRIPTION OF THE PREFERRED EMBODIMENT

Figure 1:
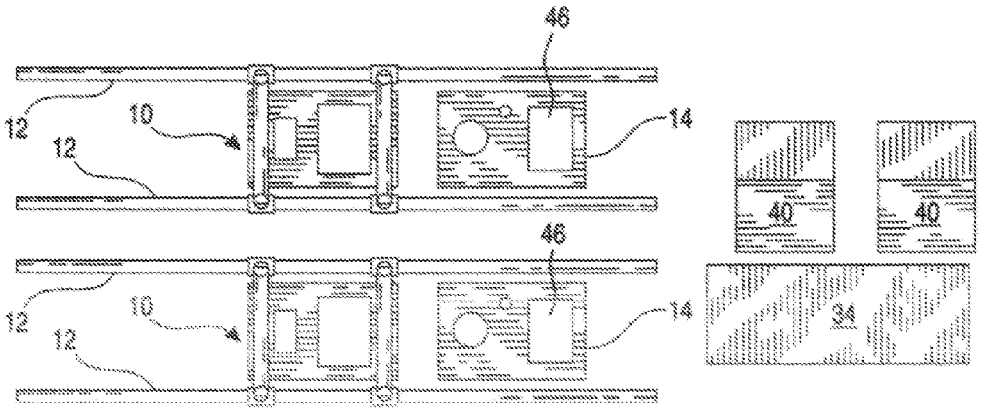
FIG. 1 is a top view of a deck arrangement for two TCDs and cuttings boxes.
Figure 2:
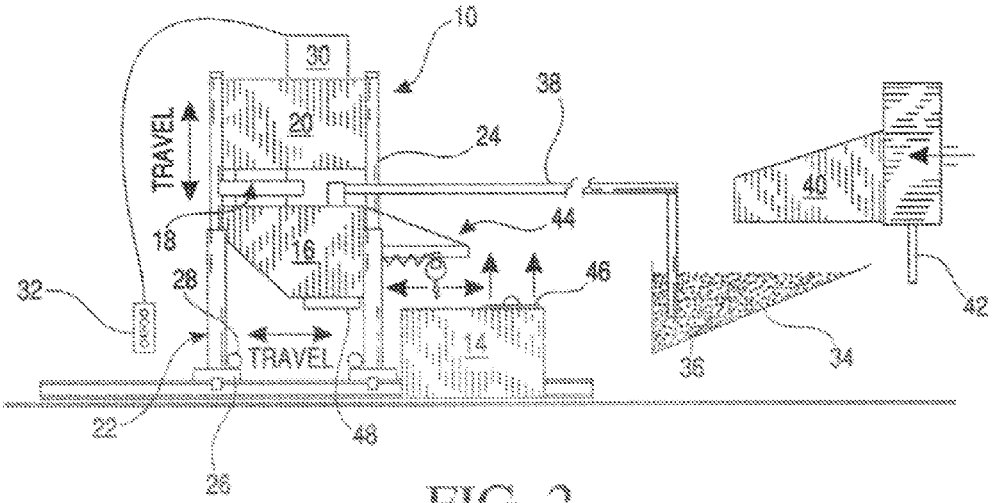
FIG. 2 is a vertical elevation view of a TCD and a cuttings box on deck.

As first seen in FIG. 1 one or more of the TCDs 10 may be movably disposed along the deck of a drilling rig having a generally horizontal surface or nearby, generally horizontal, work surface. In preferred embodiment of the invention one or more TCDs 10 are supported and guided by a horizontally disposed rail system 12 along which they move. The cuttings boxes 14 are aligned between the rails 12 or otherwise guided so as to allow the TCDs 10 to pass over them. As can be seen in FIG. 2 the TCDs include a vacuum tank 16, a blower assembly 18, and an exhaust unit 20 which may be supported on bridge assembly 22. The bridge assembly 22 is includes lifting legs 24 supported by rolling trucks 26 driven by motors 28 powered by a power unit 30 located on the exhaust unit 20 controlled by a remote switch module or pendent 32. Other configurations may be supporting the TCD 10 from wheeled assembly engage directly with deck of drilling rig or other nearby surface or supporting the TCD 10 upon skid assembly movably engaged with deck of drilling rig or other generally horizontal work surface. The drilling rig crane could also be used to reposition the entire unit 10 and/or its relevant components when reconfiguring. So long as TCDs are repositionable on deck of drilling rig or other generally horizontal work surface a purpose of the invention is satisfied. Other configurations of the TCD 10 may also include various means for lifting the vacuum tank 16, the blower assembly 18, and/or exhaust unit 20 including the power and control unit 30 within bridge 22. Such methods may include chain or cable hoist, electric drives, etc. The vacuum tank 16, the blower assembly 18, and/or exhaust unit 20 including the power and control unit 30 may also be located remotely from the TCD to reduce overall height and lower its center of gravity.

Cuttings 36 are vacuumed by the blower assembly 18 from a cutting trough 34, where they are deposited from shaker screens 40 used to remove and recover the majority of their residual mud and drilling fluids, through a cuttings feed line 38 connected to the vacuum tank 16. Recovered mud and drilling fluids are dispelled from the screens 40 through return line 42. In preferred embodiment of the invention the TCD is equipped with a winch assembly 44 for lifting and replacing the cover lids 46 from the cuttings boxes 14 to allow the adaptive seal 48 located on the bottom of the vacuum tank 16 to engage an opening in the cuttings box exposed by removal of the lid 46 and thus form a vacuum seal. This positioning may be controlled by an operator or achieved by automatic sensing systems. Other methods may be employed for lifting and moving the cuttings box lids which may include the use of a crane, or separate gantry.

As previously stated other configurations may also put the vacuum tank 16, the blower assembly 18 and/or exhaust unit 20 on the deck and provide a conduit between the adaptive seal 48 and the blower assembly 18. In this configuration, the cuttings 36 would be drawn into the cuttings box 14 by way of conduit 38. The resulting assembly could feed cuttings to other cuttings processing equipment, such as, cuttings dryers, cuttings injection and the like.

Figure 3:
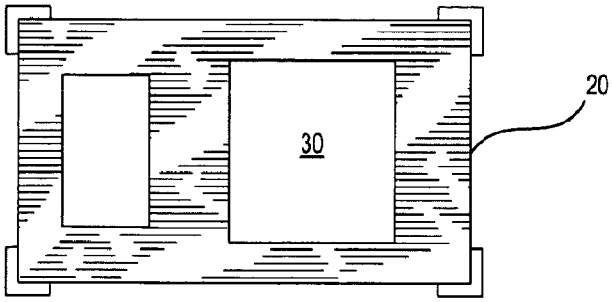
FIG. 3 is a top view of the TCD.

As seen in FIG. 2 the cuttings 36 are drawn through the transfer line 38 into the vacuum tanks 16 the heavy cuttings and fluids 36 where, due to the slowing of the velocity of air through the vacuum tanks 16, due to the greater volume they present, are allowed to fall into the cuttings boxes by virtue of gravity. Those skilled in the art will recognize that vacuum tank 16 and cutting box 14 may be, but need not necessarily be, sealingly engaged with each other to transfer cutting into vacuum tank 16 and then move them into cuttings box 14 (or other container for receiving drill cuttings). Instead the discharge at the bottom of vacuum tank 16 might be closed by door which might be selectively opened in order to cause drill cuttings in vacuum tank 16 to drop therefrom and into opening at top of cutting box or other container disposed below. Such embodiment is intended to be comprehended within the scope of the invention herein disclosed and claimed. Those skilled in the art will recognize that the entirety of vacuum tank 16 may be, but need not, necessarily be, used to cause drill cutting to fall into cuttings boxes (or other containers for receiving drill cuttings). If desired only the top of vacuum tank 16 (along with suction line 38 and blower assembly 18) could be used to sealingly engaged to opening at top of cuttings box 14 and when so engaged the cutting box would itself form the lower portion a vacuum tank into which drill cuttings and drilling fluid could be drawn (and under the influence of gravity fall into said cuttings box (or other container) as the velocity air slows due to its larger (than cross-sectional area of suction line 38) cross-sectional area. In this embodiment, which is intended to be comprehended by the invention herein disclosed and claimed) it is only said top of vacuum tank 16 (forming "lid" for cutting box or other container for receiving drill cuttings) that need be attached to vertically movable section 24 of TCD 10. Sensors may be used to detect the level of the cuttings 36 in each box 14 thus signaling the TCD 10 to move to the next box 14 in line. In preferred embodiment of the invention the massive exhaust chamber 20 provides support for the power system 30 seen in FIG. 3.

Figure 4:
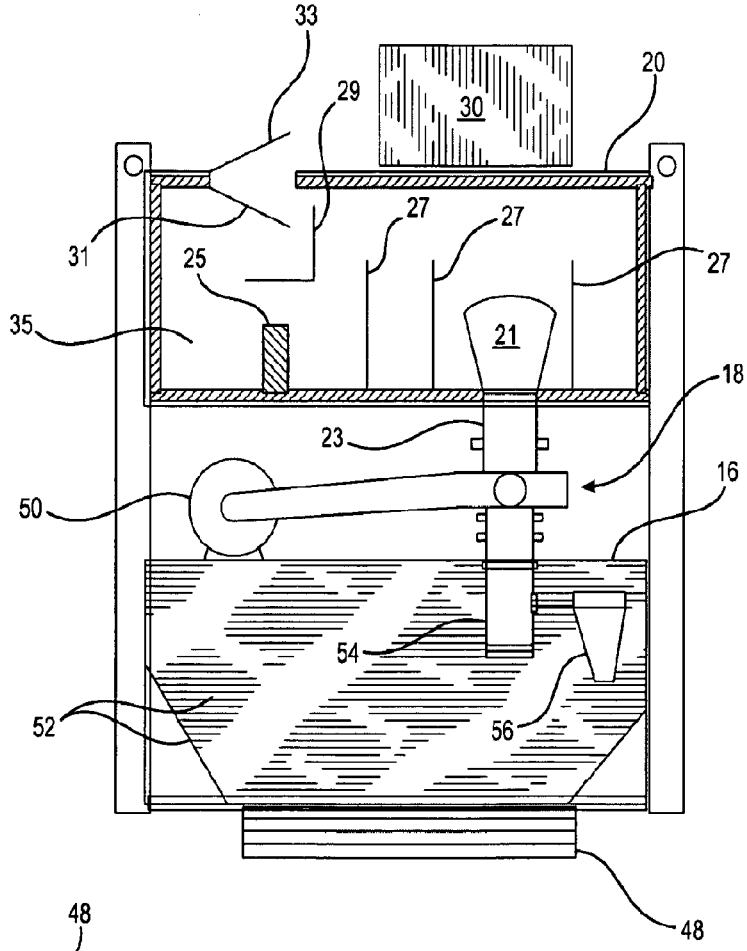
FIG. 4 is a cross-sectional vertical elevation view of a TCD.
Figure 5:
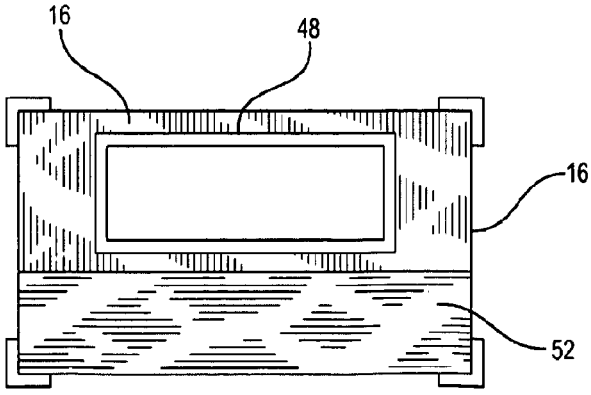
FIG. 5 is a bottom view of a TCD.

Looking now at FIG. 4 we see that the primary elements of the TCD includes the vacuum tank 16 which supports elements of the blower assembly 18 including a drive motor 50. In preferred embodiment of the invention vacuum tank 16 has beveled or sloping rear walls and possible internal side walls or baffle 52 to prevent bridging. An internal wet filter 54 and a cyclone 56 may be used to reduce internal moisture. The vacuum seal 48 seen in FIG. 5 be adapted for use with a variety of cuttings boxes, dryers, processing tanks etc. and may be configured as an accordion type duct. Exhaust chamber 20 is essentially a large insulated vessel having an internal flared air discharge 21 connected by duct 23 to the outlet of the blower assembly 18. Commercially available exhaust silencers may be used in place of the exhaust chamber 20. A number of internal baffles, 25 and 27, 29, 31 are also provided within the exhaust chamber to muffle the sound waves prior to discharge through the gate 33. Additional insulating material 35 may also be placed within the exhaust chamber.

Figure 6:
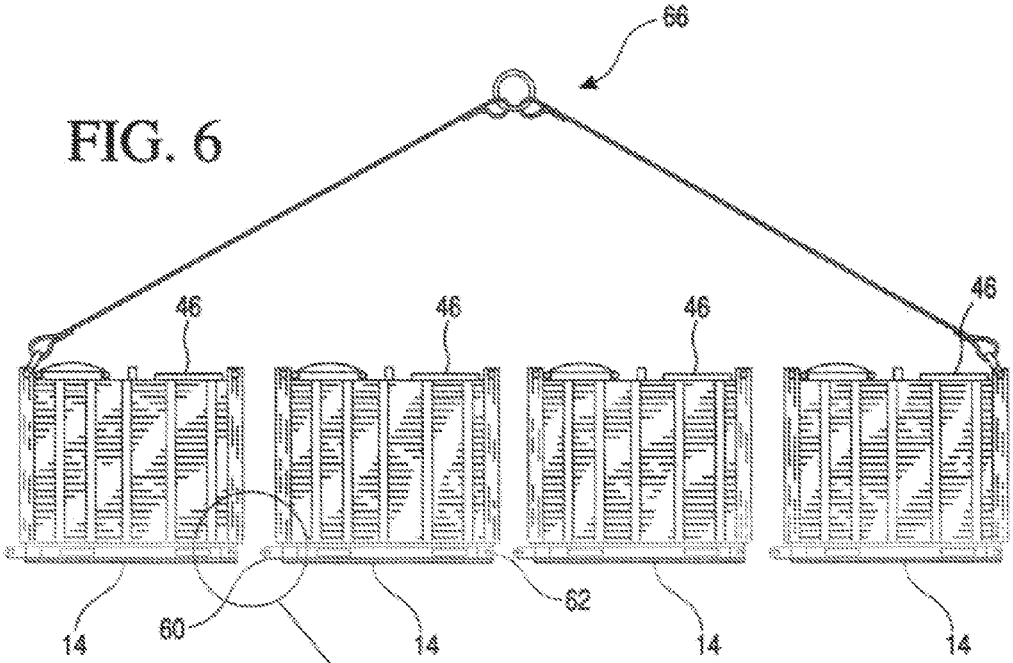
FIG. 6 is a side elevation view of a lift arrangement for multiple cuttings boxes.
Figure 7:
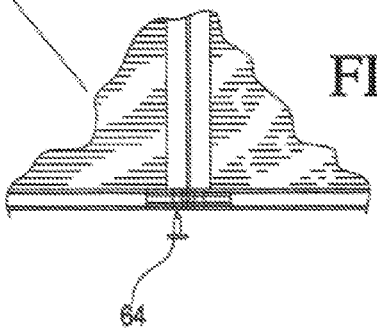
FIG. 7 is side elevation view of a coupling embodiment for cuttings boxes.
Figure 8:
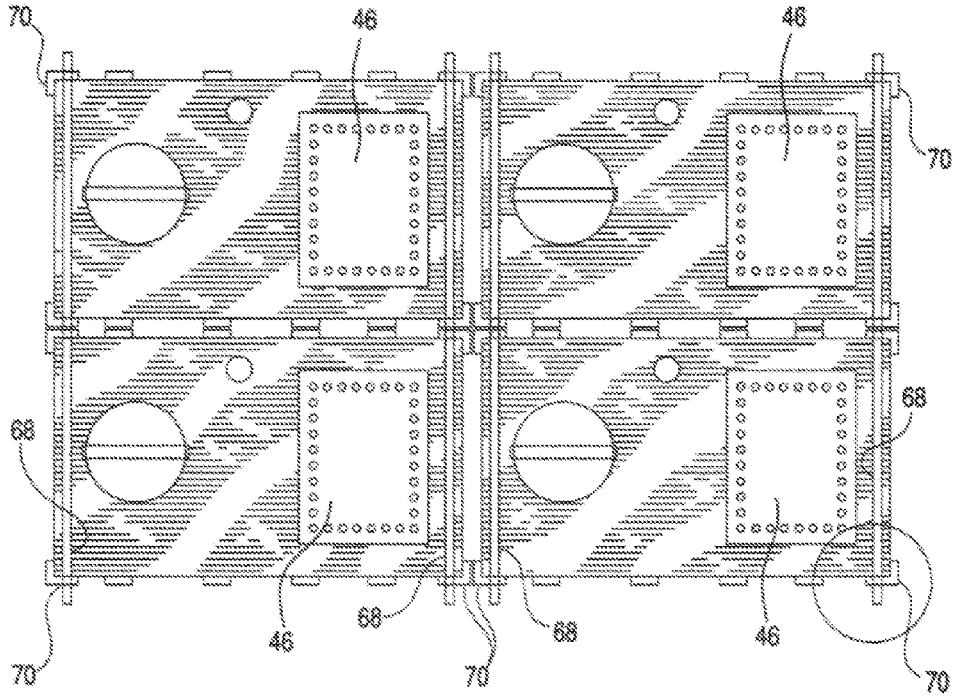
FIG. 8 is a top view of a coupling embodiment for cuttings boxes.
Figure 9:
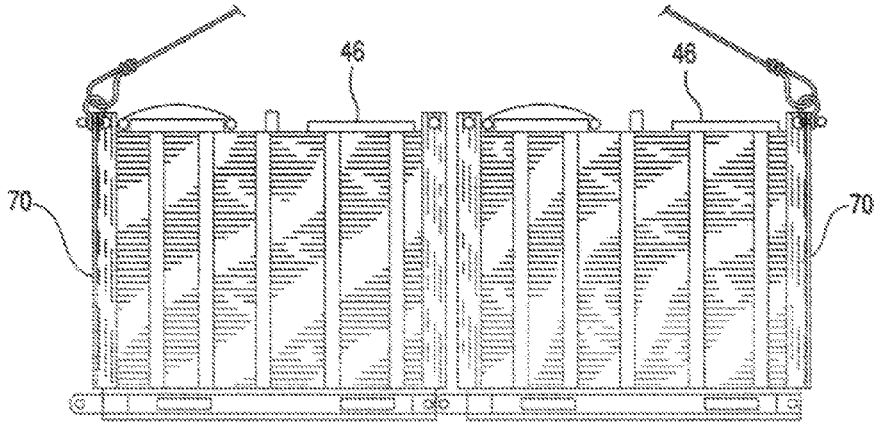
FIG. 9 is a side elevation view for the arrangement shown in FIG. 8.

As shown in FIG. 6 cuttings boxes 14 may be grouped or ganged for lifting to and from supply boats or rearranged on deck thereby reducing the number of lifts required thus reducing crane time and reducing potential for accidents during heavy seas. By installing couplings on each box the boxes may be shackled or pinned as shown in FIG. 7 into group arrangements of 2, 4 or more inline or in quads as shown in FIGS. 8 and 9. As seen in FIG. 7 each box may be fitted with pad eyes 50 and receiving eyes 62 at each corner, which may be coupled by inserting a pin 64. A bridal or sling 66 can then be attached to each upper corner of the group for the lift. Quads as shown in FIG. 8 may be coupled using a rod 68 passed though eyes in the vertical corner members 70 in addition to the lower pin coupling arrangement shown in FIG. 7 as and seen in FIG. 9.

Figure 10:
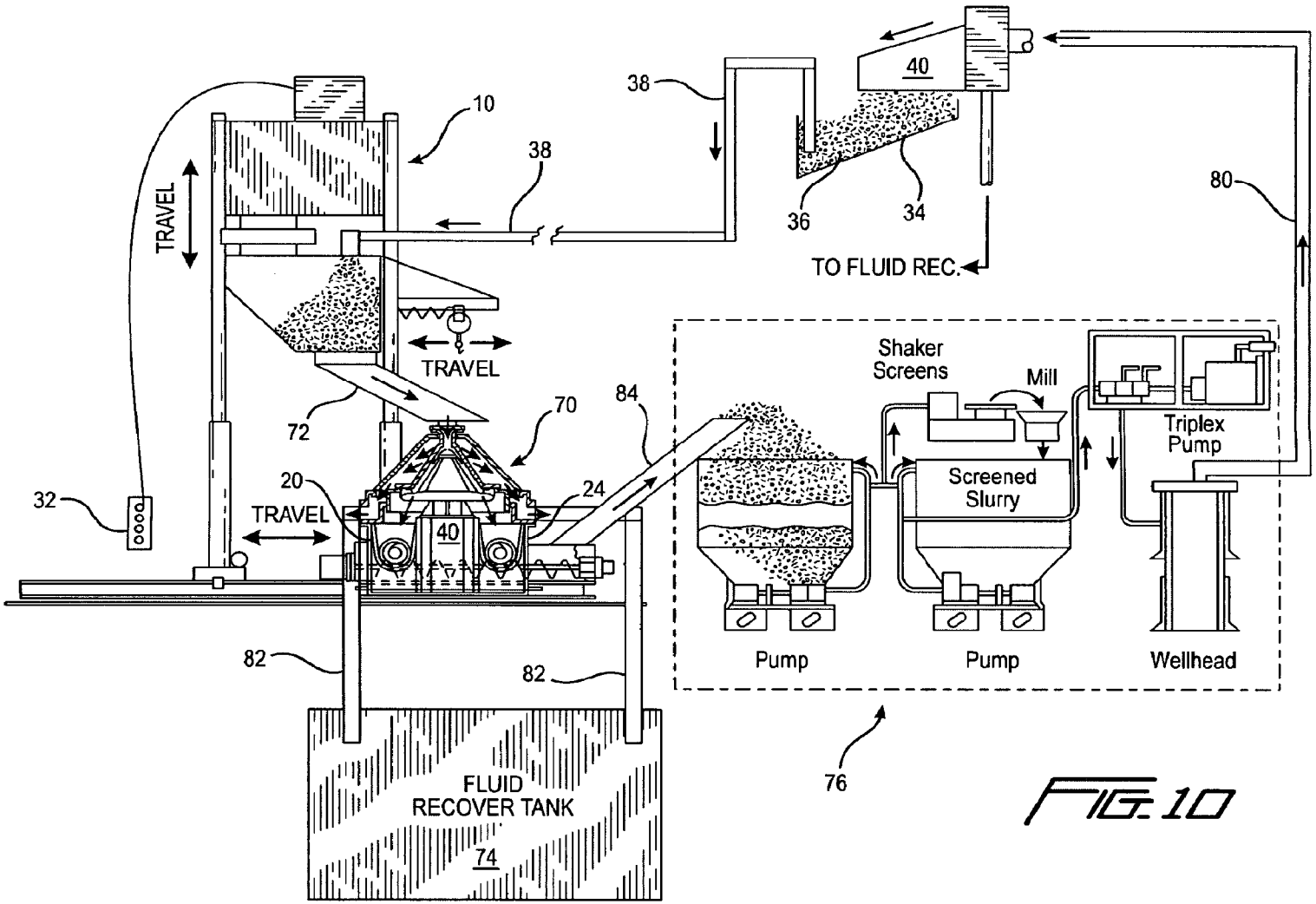
FIG. 10 is a side elevation view of a general arrangement diagram for applying the TCD to a dryer/recovery processor and cuttings injection system.

Ganged cuttings boxes may be lifted by crane to and from a work boat As shown in FIG. 10 the TCD 10 may be adapted for use with centrifugal dryers by a duct 72 or other conveying methods so that additional mud and drilling fluid residue can be removed and returned to a mud and fluid recovery tank 74 prior to the cuttings being conveyed or vacuumed into a cuttings injection processing system 76.

As further shown in FIG. 10 drill cuttings are piped from the borehole to the shaker 40 where the majority of the residue of mud and drilling fluid is removed. The cuttings 36 are then vacuumed from the cuttings trough through line 38 to the vacuum tank 16 attached to the vertically movable section of TCD 10. Cuttings 36 are then discharged via chute 72 into a mud and fluids recovery units 7 where the mud and fluids are separated from the cuttings and separated fluids discharged to the recovery tank 74 via tubes 82. The cuttings 36 are then conveyed via conveyance 84 or otherwise discharged into the injection system 76 or other such processing systems for possible injection into earth formations down-hole thus completing the loop.

Figure 11:
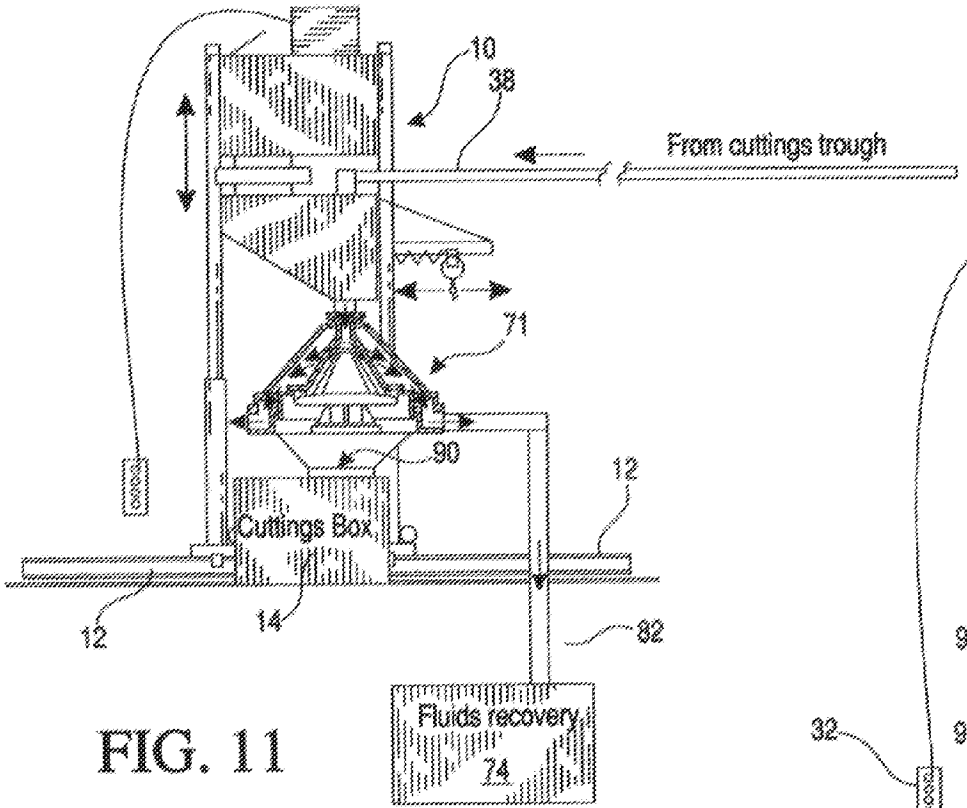
FIG. 11 is a side elevation view of a TCD fitted with a dryer system adapted for discharge of cuttings into cuttings boxes by vacuum.

As further seen in FIG. 11 the TCD 10 may be fitted with a dryer assembly 7 which may or may not include a conveying system. In this configuration the TCD 10 can be moved along a row of cuttings boxes 14 or storage tanks (not shown) communally used for transporting such cuttings. Using dryer 7 to remove the majority of fluid and discharge them via line 82 to the fluids recovery tank 74 decreases the volume of the cuttings in each box. Use of a buffer lid 90 insures complete filling of the boxes 14 or tanks.

Figure 12:
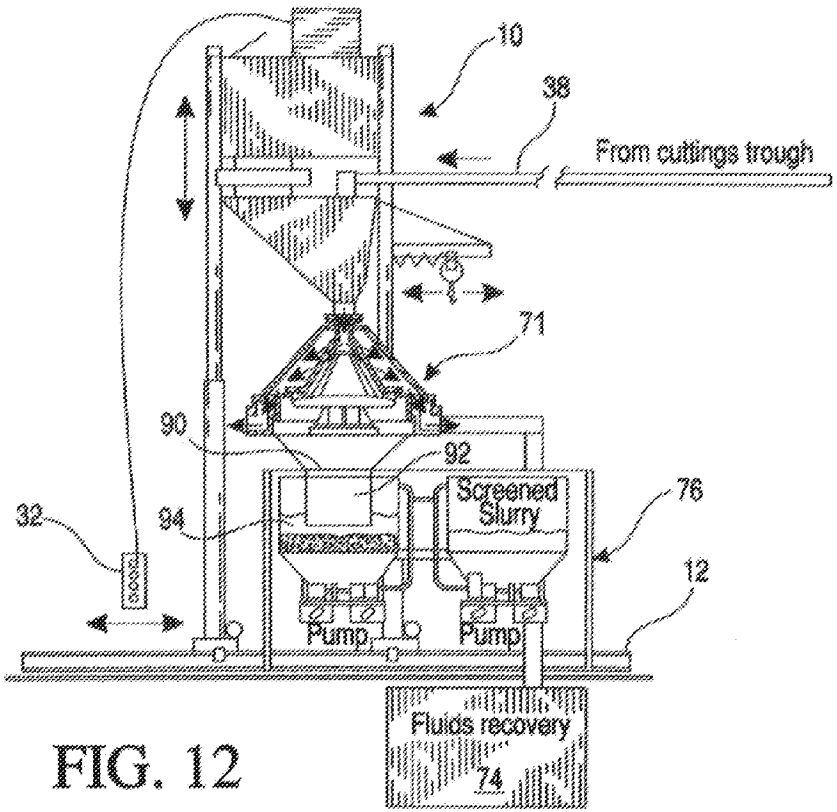
FIG. 12 is a side elevation view of a TCD fitted with a dryer system adapted for discharge of drill cuttings into a cutting injection unit by vacuum.

As seen in FIG. 12 the TCD 10 in the dryer configuration may be used to remove and recover drilling fluids while discharging the dried cuttings into an open vessel, cuttings injection unit 76. This is accomplished by the addition of a hood 92 to the buffer lid 90 and submerging the hood in the slurry 94 of on of the slurry tanks thus maintaining a vacuum through the system Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

The invention claimed is:

1. A system for the efficient handling of drill cuttings produced during the drilling of an earth bore, comprising:

a. a work-deck having a horizontal surface;

b. a traveling cuttings distributor disposed on said work-deck and movable horizontally along said work-deck and having an upper section which is movable vertically;

c. a means for selectively moving said traveling cuttings distributor horizontally;

d. a means for selectively moving the upper section of said traveling cuttings distributor vertically;

e. a lid supported by said upper section of said traveling cuttings distributor, said lid having a first port and a second port;

f. a means for drawing air from said first port;

g. a suction line in communication with said second port and with a source of said drill cuttings;

h. a first container having an opening at the top, a sufficiently large volume so that the velocity of air flowing therethrough slows sufficiently for drill cuttings to fall into said first container under the influence of gravity as air passes through said first container and a discharge port at the bottom for discharging drill cuttings; and, i. a means for sealingly engaging said lid to the opening at the top of said first container.

2. The system of claim 1 wherein said first container comprises a vacuum tank supported by said upper section of said traveling cuttings distributor.

3. The system of claim 2 further comprising second drill cuttings box, disposed on said work-deck, said drill cuttings box having an opening at the top adapted to sealingly engage with the discharge port of said vacuum tank.

4. The system of claim 3 further comprising a cuttings dryer supported by the upper section of said traveling cuttings distributor and is adapted to receive drill cuttings from said discharge port of said vacuum tank.

5. The system of claim 4 further comprising a second drill cuttings box, disposed on said work-deck, having an opening at the top adapted to receive drill cuttings discharged from said cuttings dryer.

6. The system of claim 4 wherein said discharge port of said vacuum tank further comprises a selectively openable door.

7. The system of claim 3 wherein said discharge port of said vacuum tank further comprises a selectively openable door.

8. The system of claim 2 further comprising a cuttings dryer supported by the upper section of said traveling cuttings distributor and is adapted to receive drill cuttings from said discharge port of said vacuum tank.

9. The system of claim 8 further comprising a second drill cuttings box, disposed on said work-deck, having an opening at the top adapted to receive drill cuttings discharged from said cuttings dryer.

10. The system of claim 8 wherein said discharge port of said vacuum tank further comprises a selectively openable door.

11. The system of claim 2 wherein said discharge port of said vacuum tank further comprises a selectively openable door.

12. The system of claim 1 wherein said first container comprises a drill cuttings box supported by said work-deck.

* * * * *